United States Patent [19]

Dunn

[11] Patent Number: 4,953,638

[45] Date of Patent: Sep. 4, 1990

[54] METHOD OF AND APPARATUS FOR DRILLING A HORIZONTAL CONTROLLED BOREHOLE IN THE EARTH

[75] Inventor: Richard P. Dunn, Wichita Falls, Tex.

[73] Assignee: The Charles Machine Works, Inc., Perry, Okla.

[21] Appl. No.: 211,889

[22] Filed: Jun. 27, 1988

[51] Int. Cl.[5] ..... E21B 7/06; E21B 10/00

[52] U.S. Cl. ..... 175/61; 33/304; 175/45; 175/62; 175/73; 175/162; 175/220; 175/400

[58] Field of Search ..... 175/45, 62, 61, 75, 175/73, 113, 162, 122, 220, 393, 397, 398, 399, 400, 44; 33/228, 285, 286, 302, 304, 305, 308, 332, 371–373

[56] References Cited

U.S. PATENT DOCUMENTS

| | | | |
|---|---|---|---|
| 1,766,202 | 6/1930 | Thompson | 33/304 |
| 2,122,063 | 6/1938 | Hughes | 175/61 X |
| 2,196,940 | 4/1940 | Potts | 175/399 X |
| 2,324,102 | 7/1943 | Miller et al. | 175/61 X |
| 2,350,986 | 6/1944 | Collins | 175/400 X |
| 2,686,660 | 8/1954 | Storm | 175/45 X |
| 2,903,239 | 9/1959 | Standridge | 175/399 X |
| 3,451,491 | 6/1969 | Clelland | 175/62 X |
| 3,746,106 | 7/1973 | McCullough et al. | 175/45 |
| 4,024,721 | 5/1977 | Takada et al. | 175/62 X |
| 4,306,627 | 12/1981 | Cheung et al. | 175/424 |
| 4,674,579 | 6/1987 | Geller et al. | 175/45 |
| 4,679,637 | 7/1987 | Cherrington et al. | 175/61 |
| 4,694,913 | 9/1987 | McDonald et al. | 175/61 |
| 4,790,394 | 12/1988 | Dickinson, III et al. | 175/61 |

FOREIGN PATENT DOCUMENTS 2126267 3/1984 United Kingdom .

OTHER PUBLICATIONS

Texas Mill Supply, Inc. advertisement for Curv-O-Mark (undated).

*Primary Examiner*—Hoang C. Dang

*Attorney, Agent, or Firm*—Banner, Birch, McKie & Beckett

[57] ABSTRACT

A method of boring a hole in the earth such as for passing under obstacles, not limited, but including roadways, rivers, dikes, canals or other inexcessible areas where it is impossible to trench a ditch including the steps of advancing a rotating drill string in a direction inclined to the earth's surface to establish a borehole, stopping the rotation and advancement of the drill string, aligning the drill pipe so that the drill bit is inclined at an angle relative to the axis of the drill string towards a new direction desired for the borehole, advancing the drill string and drill bit a short distance without rotation, resuming rotation advancement of the drill string for a short distance, sequentially repeating the steps of advancing the rotationally aligned drill string without rotation to move the drill bit in the newly desired direction, followed by rotation with simultaneous advancement until the new direction of drilling is achieved, after which, until a still different direction is desired, drilling is continued by simultaneously rotating and advancing the drill string.

5 Claims, 3 Drawing Sheets

METHOD OF AND APPARATUS FOR DRILLING A HORIZONTAL CONTROLLED BOREHOLE IN THE EARTH

SUMMARY OF THE INVENTION

The use of boring machines for drilling boreholes horizontally such as under a roadway or other obstruction wherein a hole needs to be provided and wherein the surface of the earth cannot be disturbed is a well known practice. For examples of horizontal boring machines reference see U.S. Pat. No. 3,902,563 and U.S. Design Patent No. 235,372. The use of a horizontal boring machine of the known type, such as exemplified in these two prior issued patents, has the problem that in order to provide access to an area where horizontal drilling is required it is frequently necessary to dig a relatively deep ditch. A horizontal boring machine is placed in position in the ditch and then the horizontal bore hole is drilled. Access to the hole drilled in such horizontal manner also requires a ditch on the opposite side of the obstruction. Setting a drilling machine into a ditch for horizontal boring is relatively time consuming and expensive.

The present invention is a new means of boring holes in the earth's surface in a manner to provide drilling underneath an obstruction, such as a roadway. The present invention provides a machine which can be set on the earth's surface and in which the boring does not have to be entirely horizontal and in which the boring can be accomplished in such a way that a borehole may be drilled from the earth's surface downwardly at an angle and then leveled off the required depth and then upwardly inclined back to the earth's surface. The method includes positioning a boring machine on the surface of the earth adjacent a selected borehole entry point, the boring machine having facilities to axially advance and to selectably rotate drill string. The drill string is in the form of a plurality of lengths of pipe which are provided with male threads on one end and female threads on the other so that the pipe may be interconnected together in sequence to provide a drill string. At the end of the drill string a drill is utilized which has a blade inclined at an angle to the axis of the drill string to which the drill bit is attached.

The drill string is simultaneously rotated and advanced by means of the boring machine to establish a borehole in the earth. The drilling operation wherein the pipe is simultaneously rotated and axially advanced is continued until a change in direction of the borehole is desired. This typically occurs when the borehole is near a desired depth and when the borehole is to be substantially horizontal for a distance. In order to change the direction of the borehole the following sequence is employed:

1. The rotation of the drill string is stopped.
2. The rotational position of the drill string is oriented so that the drill bit blade is inclined at an angle relative to the axis of the drill string towards the new direction of the borehole desired.
3. The drill string is axially advanced without rotation to axially advance the drill bit a short distance such that the blade moves the drill bit in the earth towards the new desired direction.
4. Simultaneous rotation and axial advancement of the drill string is resumed for a short distance.

5. Sequentially repeating steps 1, 2, 3 and 4 until the direction of the borehole is in the new direction desired.

Thereafter, the drill string is axially advanced and simultaneously rotated until it is again desirable to change directions. This typically can occur when a borehole has reached a point adjacent the opposite side of the obstruction under which the borehole is being drilled. At this stage in the drilling of the borehole it is desirable to have the direction of the borehole inclined upwardly so that the borehole will emerge at the surface of the earth on the opposite side of the obstruction. To again change the direction of the borehole the same sequence is repeated, that is, the rotation of the drill string is stopped, the orientation of the drill string is corrected so that the drill bit blade is inclined in the newly desired direction, that is, in this example, upwardly; the drill string is axially advanced without rotation a short distance, the drill string is then rotated and axially advanced a short distance, and the sequence is repeated until the new direction of drilling the borehole is attained. After the new direction is attained, the borehole is drilled by simultaneously rotating and advancing the drill string until the borehole is completed.

One of the important elements in the invention is the drill bit for the use at the end of the drill string. The bit has means of drilling a borehole in the earth in the axial direction of the drill string when the drill string is simultaneously rotated and axially advanced and also has means for changing the direction of the borehole when the drill bit is advanced without rotation. For this purpose the drill bit is made up of a drill body having a rearward end and a forward end, and an internally threaded opening in the rearward end. The drill bit body is threadably attached to the forward end of the first drill pipe making up the drill string. A blade is affixed to the drill bit body at the forward end thereof. The blade is affixed to the drill bit body at the forward end thereof. The blade is flat or in a plane which extends at an acute angle relative to the axis of the threaded opening in the drill bit body; that is, the blade is in a plane intersecting the axis of the drill string and in the area of the drill string immediately rearwardly of the drill bit. This flat blade causes the drill bit to deflect laterally when it is forced through the earth's surface without rotation.

The machine which is utilized for practicing the method of this invention includes a frame supportable on the earth's surface providing an elongated linear travel path, preferably formed by opposed, paralleled channels, the frame having a forward and a rearward end. A rotary machine is supported on the frame and in the travel path. A drill string is made up of a plurality of drill pipe each having a male thread at one end and a female threaded opening at the other end and each being attachable at one end to the rotary machine and to each other to form in series a drill string, the rearward end of the drill string being attached to the rotary machine.

A drill bit is affixed to the drill string forward end, the drill bit having a blade thereon to deviate the direction of a borehole when the bit is axially advanced without rotation and for maintaining the direction of a borehole when advanced during rotation. An orientation directional indicator is secured to the drill string adjacent the drill machine so that the angle of the plane of the drill bit head can at all times be known.

The frame and boring machine have means in cooperation with each other to axially advance the boring machine and thereby the drill string while the drill string is rotated or when not rotating.

This disclosure provides an improved method for boring a hole in the earth's surface in which the direction of the borehole can be changed. Therefore, the disclosure provides a method, an apparatus and a drill bit which afford means of substantially reducing the time and expense necessary to provide a passageway underneath an obstruction on the surface of the earth. For a better understanding of the invention reference may be had to the following description and claims, taken in conjunction with the attached drawings.

DESCRIPTION OF THE PREFERRED EMBODIMENT

Figure 1:
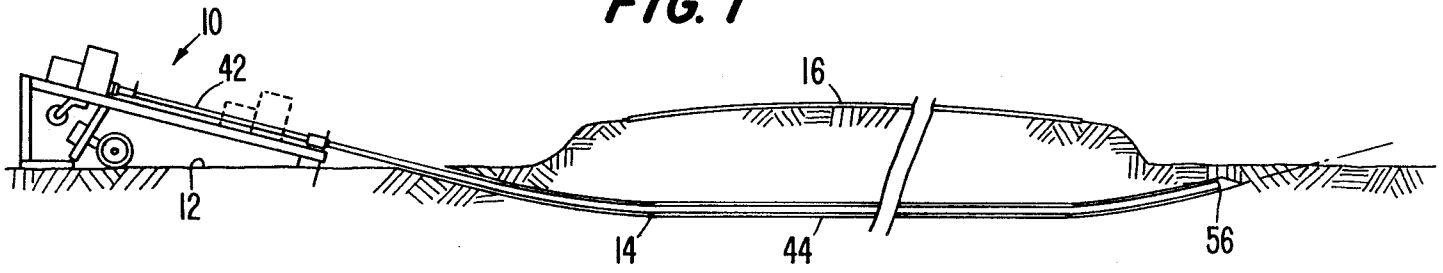
FIG. 1 is an elevational view of a boring machine as employed in practicing the method of the invention for drilling a borehole in the earth.

Referring to the drawing, and first to FIG. 1, the environment in which the apparatus of this invention is used is illustrated. The boring machine is generally indicated by the numeral 10 and is shown resting on the earth's surface 12 and in position for forming a borehole 14 underneath an obstruction on the earth such as a roadway 16. As shown in FIG. 1, by using the machine 10 the direction of the borehole can be changed as the borehole passes under roadway 16. This illustrates how the machine 10 can be utilized to form a borehole 14 under an obstruction without first digging a deep ditch in which to place a horizontal boring machine, and, also, without having to dig a deep ditch on the opposite side of the obstruction where the borehole is to be received. While the method of drilling a borehole and the machine used therewith will be described as showing the borehole being drilled from the earth's surface 12, it can be seen that the machine can be used in a shallow ditch if desired; but it should be kept in mind that the main emphasis of the method and machine of this invention is that of drilling a borehole in which the direction of the borehole can be changed during the drilling process.

Figure 2:
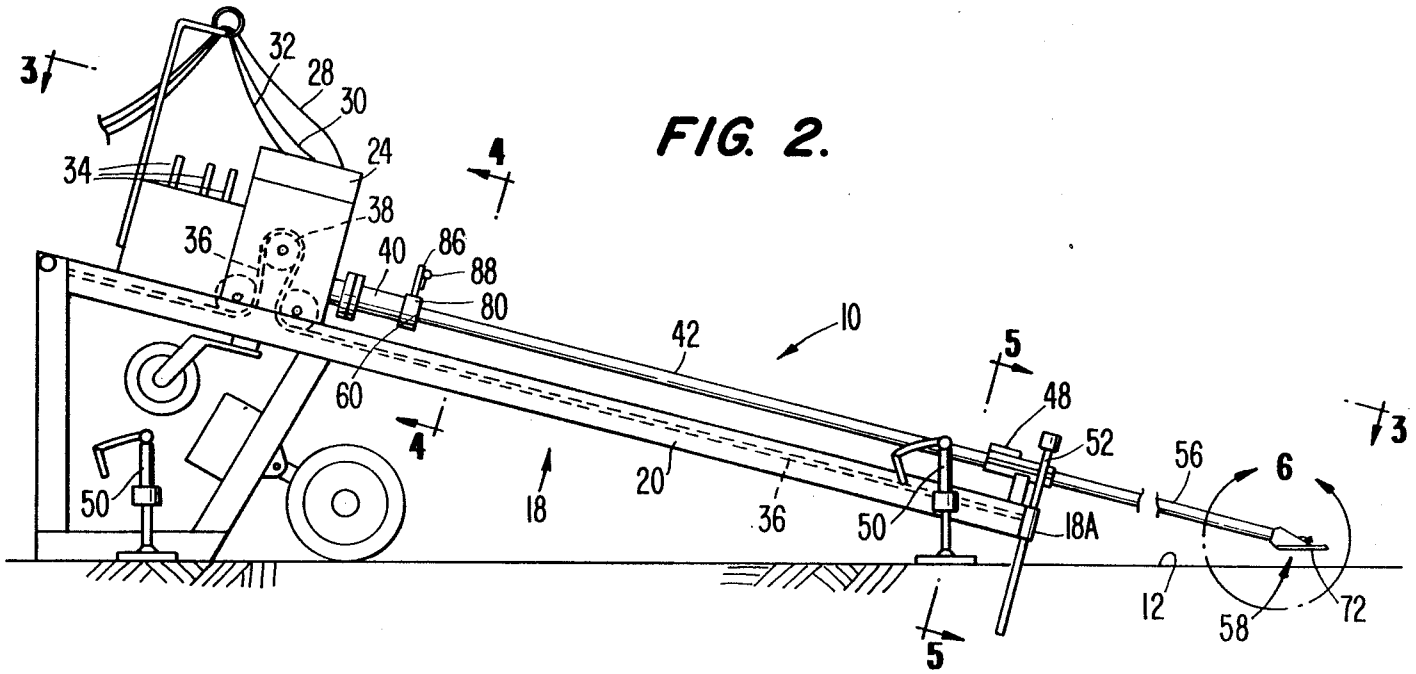
FIG. 2 is an elevational, enlarged scale view of the boring machine of FIG. 1.
Figure 3:
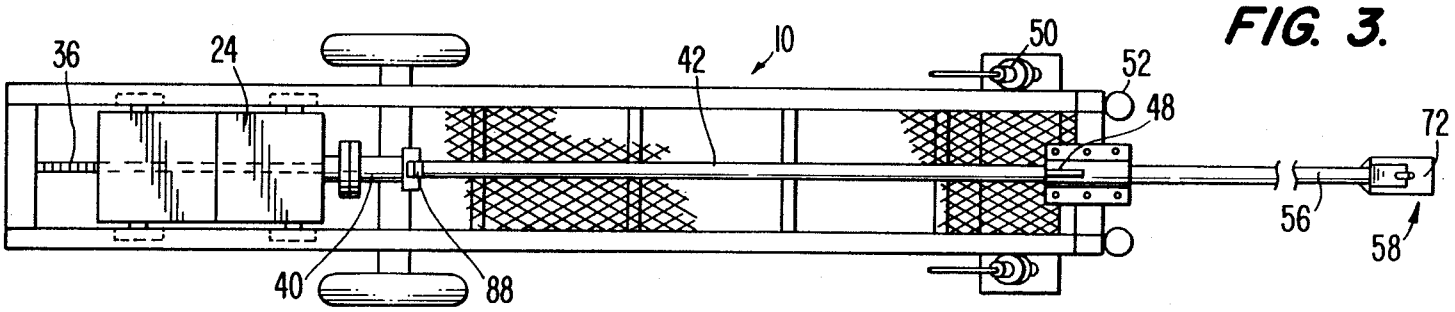
FIG. 3 is a top plan view of the boring machine of this disclosure taken along the line of 3—3 of FIG. 2.

Referring to FIGS. 2 and 3, more details of the boring machine are illustrated.

The machine 10 is formed of a frame 18 which provides a linear pathway. The linear pathway is preferably provided by spaced-a-part channels 20 and 22 best seen in FIGS. 4 and 5. A rotary machine generally indicated by the numeral 24 is supported on the framework 10, and, more specifically, is supported on wheels 26 which are received within channels 20 and 22.

Figure 4:
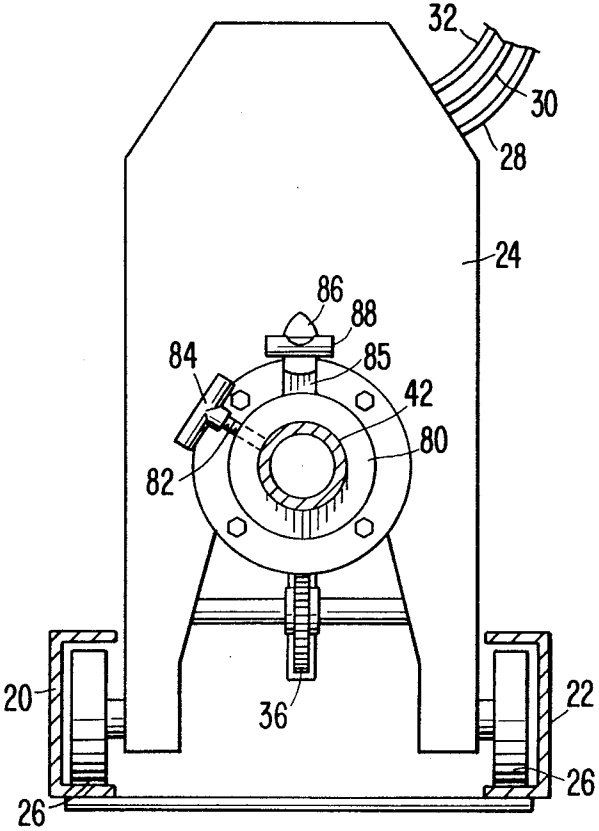
FIG. 4 is an elevational, enlarged scale view of the boring machine as shown in FIGS. 1 and 2, and taken along the line of 4—4 of FIG. 2.

The boring machine 24 is supplied by energy such as by hydraulic pressure through hoses 28 and 30. This hydraulic energy can be supplied by an engine driven trailer mounted hydraulic pump (not shown) which is positioned on the earth's surface adjacent the drilling machine. The use of hydraulic energy is by example only as the boring machine 12 could be operated by electrical energy, an engine or the like. The use of hydraulic energy supplied by a trailer mounted engine driven pump is preferred because of the durability and dependability of hydraulically operated systems. The third hose 32 seen in FIGS. 2 and 4 is used for supplying water for a purpose to be described subsequently.

By means of control levers 34 hydraulic energy can be controlled to cause the bore machine 24 to be linearly moved in the pathway provided by channels 20 and 22, and at the same time to cause a drill pipe to be axially rotated. The linear advancement or withdrawal of the boring machine 24 is accomplished by means of a chain 36 which is attached at one end to the frame front end 18A and at the other end to the frame rearward end 18B. The chain 36 passes over a cog wheel 38, the rotation of which is controlled by one of the levers 34 to connect hydraulic power to a hydraulic motor (not shown) which rotates the cog wheel 38 in the forward or in the rearward direction or which maintains it in a non-rotary position.

Extending from the forward end of the boring machine 24 is a shaft 40 which has means to receive the male or female threaded end of a drill pipe 42. A plurality of drill pipes 42 are employed and when the drill pipes are assembled together they form a drill string 44 as seen in FIG. 1. The drill pipes 42 may be of a length such as 5 foot, 10 foot, 12 feet and/or 20 foot length and when sequentially joined can form a drill string of a length determined by the length of the hole to be bored.

Figure 5:
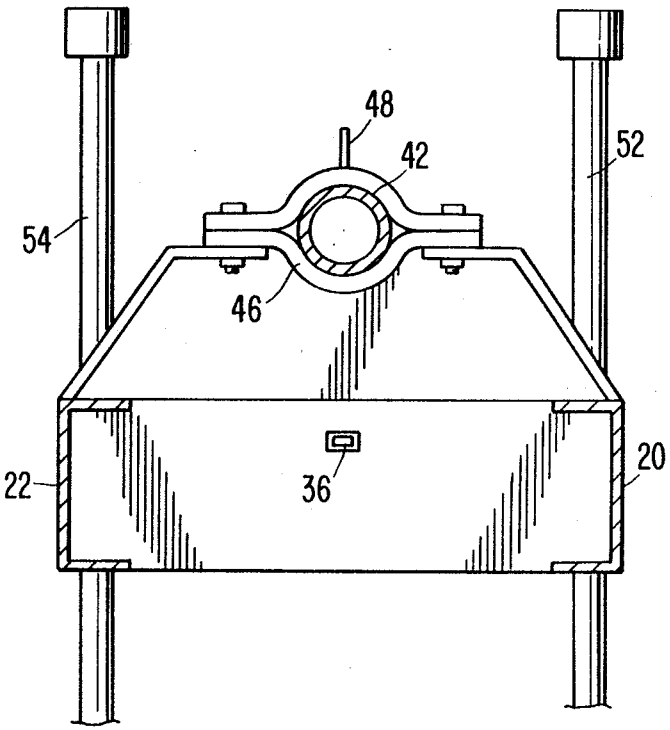
FIG. 5 is an elevational, cross-sectional, enlarged scale view taken along the line 5—5 of FIG. 2 showing how the drill string is supported and rotationally oriented.

Adjacent the forward end 18B of the frame is a drill pipe support 46, best seen in FIG. 5. The drill pipe support maintains the drill pipe in a straight line parallel to the guide path formed by channels 20 and 22. The drill pipe support includes a sight 48 the purpose of which will be described subsequently.

Positioned adjacent the frame forward end and rearward ends are jacks 50 by which the elevation of the frame relative to the earth's surface 12 may be adjusted. In addition, at the front end 18A are opposed stakes 52 and 54 which are slideably received by the frame front end. The stakes 52 and 54 may be driven in the earth's surface so as to anchor the machine during drilling operation.

Figure 8:
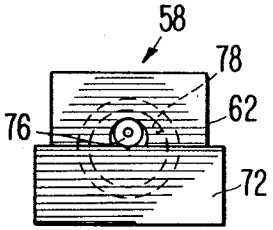
FIG. 8 is an end view taken along the line of 8—8 of FIG. 6 of the bit.
Figure 7:
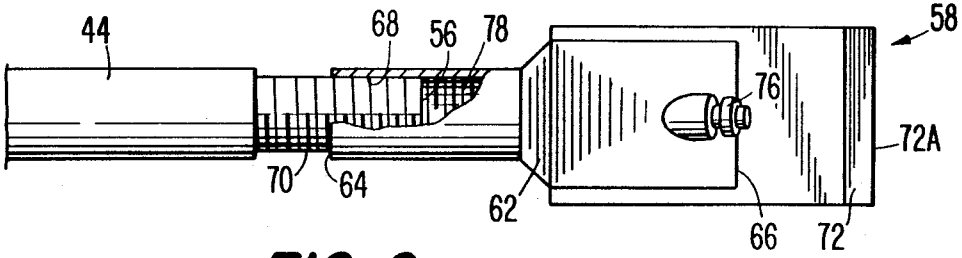
FIG. 7 is top plan view of the bit of FIG. 6.
Figure 6:
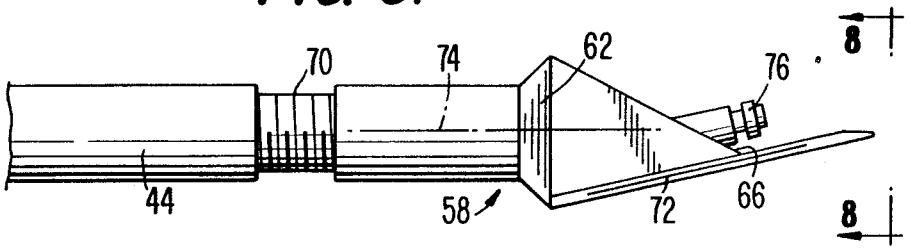
FIG. 6 is an enlarged elevational view of the boring bit of this invention as taken at (6) of FIG. 2.

Affixed to the outer end 56 of drill string 44 is a bit generally indicated by the numeral 58. The inner end 60 of the drill string is attached to shaft 40 (FIG. 2), that is, to the boring machine 24. The drill bit is best seen in FIGS. 6, 7 and 8.

The drill bit includes a body portion 62 which has a rearward end 64 and a forward end portion 66. The rearward end portion 64 includes an internally threaded recess 68 which receives the external threads 70 at the drill string forward end 56.

A blade 72 is affixed to drill bit body 62. The plane of blade 72 is inclined at an acute angle to the axis 74 of the bit internally threaded recess 68; axis 74 being also the axis of the drill string 44, that is, the portion of the drill string immediately adjacent and rearwardly of the bit. The blade 72 is preferably sharpened at its outer forward end 72A, but when rotated it cuts a circular pattern.

The body 62 of bit 58 has a fluid passageway therethrough connecting to a jet 76 and the fluid passageway 78 is in turn connected to the interior of the tubular drill string 44. As previously stated with reference to FIG. 2, hose 32 provides means of conveying water under pressure to the boring machine 24. This water is connected to the interior of drill pipe 42 and thereby to the entire drill string 44, and, thus, to the interior of bit 58. The water is ejected from the bit through jet 76 to aid in drilling action; that is, to cool blade 72 and flush away cuttings formed by the blade as it bores through the earth.

Referring back to FIGS. 2 and 4, a device which is utilized to indicate the rotational orientation of the drill string 44, and thereby the rotational orientation of drill bit 58, is shown. A ring member 80 is slideably and rotatably received on drill pipe 42. The ring has a threaded opening therein receiving a set screw 82 having handle 84. When the set screw 82 is loosened, ring 80 can be slid on drill pipe 42 and rotated relative to it.

Affixed to ring 80 is a bracket 85 having a pointer 86. In addition to the pointer 86, the bracket 85 carries a liquid bubble level 88.

The function of the ring 80 with its pointer and bubble level is to provide means of maintaining the known orientation of the drill string 44. When a drilling operation is to start, the first length of drill pipe 42 is placed in the machine and bit 58 secured tightly to it. At this juncture the bit is above ground and the operator can easily observe the orientation of blade 72. He can then affix ring 80 so that it is in accurate orientation with the blade, that is, as an example, ring 80 is affixed so that the pointer 86 points straight up with blade 72 aligned so that a plane drawn perpendicular to the plane of the blade would be vertical. With ring 80 so aligned, the set screw 82 is tightened by handle 84. Thereafter, as the drill pipe 42 is rotated and advanced into the earth the ring 80 remains in the same axial rotation orientation, rotating with the drill string. As the drill string is advanced by the advancement of machine 24 towards the forward end 18A of the boring machine the ring 80 moves with it. It can be seen that when the boring machine has advanced so that shaft 40 is adjacent the frame forward end, drilling must be stopped and a new length of pipe 42 inserted. With drilling stopped, the drill string can be aligned with the pointer 86 in alignment with the pointer 48 affixed to the drill pipe support 46. The collar 80 may then be removed and inserted on a new length of drill pipe 42 threadably secured to the drill string and the procedure continually repeated, each time tightening the set screw 88 so that the alignment of the drill bit blade 72 is always known to the operator.

To form a borehole 44 in the earth the operator attaches the drill pipe and drill bit as shown in FIG. 2, begins rotation of the drill pipe and at the same time, by means of control levels 34, causes the boring machine 24 to linearly advance in the travel path of the frame towards the forward end 16A. The drill bit 58, rotating and advancing, enters the earth and forms a borehole therein. As long as the bit 58 is rotated as it is advanced, the borehole follows generally the axis of the drill pipe; that is, the borehole continues to go straight in the direction in which it is started. In the most common application of the invention wherein the borehole is started at the earth's surface to go under an obstruction such as a highway, the borehole must first extend downwardly beneath the roadway. When the borehole has reached the necessary depth the operator can then change the direction of drilling so as to drill horizontally. This can be accomplished in the following way: When it is time to change direction, the operator stops drilling and orients the drill string so that the drill bit blade 72 is oriented in the direction desired. In the illustrated case of FIG. 1, the borehole is first changed in the direction so that instead of being inclined downwardly, it is horizontal. For this purpose the operator will stop drilling with the drill pipe 44 having collar pointer 86 pointing straight up, that is, with the bracket 84 in the vertical position. With rotation stopped and the drill string properly oriented the operator causes the drill machine 24 to move forwardly without rotating the drill pipe. After forcing the bit as far as possible, the operator begins rotations of the drill bit and continues to advance the drill string for a short distance. After a short distance of rotary boring the procedure is repeated; that is, the drill string is reoriented so that the operator knows the inclination of bit blade 72 and then he advances the bit as much as possible without rotation and repeats the procedure. The procedure may be repeated sequentially for a number of times until the direction of drilling has changed to that which is desired. After the borehole has been oriented in the desired direction, such as horizontal, the drilling can continue by simultaneous rotation and advancement of the drill string, adding new links of drill pipe as necessary until it is again time to change direction of drilling such as to cause the borehole to be inclined upwardly towards the earth's surface after the borehole has reached the opposite of the extremity of the obstruction under which the borehole is being placed. This is achieved as previously indicated; that is, by orienting the drill string to thereby orient the bit blade, advancing the bit without rotation of the drill string, rotating and advancing the drill string for short distance, reorienting the drill bit and advancing without rotation and sequentially repeating the steps until the new direction of drilling is achieved.

The experienced operator soon learns the number of sequences which are normally required in order to achieve a desired direction of drilling.

Thus, it can be seen that a method of drilling provided by the present disclosure is completely different than that of the typical horizontal boring machine. The necessity of digging ditches to the opposite sides of an obstruction in which to place a horizontal boring machine is avoided.

The claims in the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A drill bit for use at the end of a drill pipe having means of drilling a borehole in the earth in the axial direction of the drill pipe when the drill pipe is simultaneously rotated and axially advanced, and for changing the direction of the borehole when the drill bit is advanced without rotation, comprising:

a drill body having a rearward end and a forward end and having a threaded axial opening in said rearward end whereby the drill body is threadably attachable to a drill pipe, said rearward end having a greater height than said forward end and wherein said drill body tapers towards said forward end so that said drill body has a substantially triangular cross-section, said drill body having a substantially flat top surface and a substantially flat bottom surface, said top and bottom surfaces converging towards said front end;

a generally flat blade affixed to said flat bottom surface of said drill body so that the blade is at an acute angle to the axis of said threaded axial opening, said blade extending axially from said rearward end of said drill body to beyond said forward end of said drill body;

a fluid passageway through said drill body;

a fluid jet adapted to aid in drilling fixed to said fluid passageway, said fluid jet positioned behind the forward end of said blade and projecting from said flat top surface of said drill body, whereby, upon rotation of said drill pipe, said acute angle of said blade and said converging top surface of said drill body define a relief at the forward end of the borehole to thereby allow for rapid deviation in changing direction upon axially advancing said drill pipe without rotation.

2. A method of forming a borehole in the earth such as for passing under a roadway or the like comprising the steps of:

(1) positioning a boring machine on the surface of the earth adjacent a selected borehole entry point, the machine having means to axially advance and to rotate a drill string made up of a series of lengths of drill pipe, the drill string having a drill bit thereon, the drilling bit having a blade means inclined at an angle to the axis of the drill pipe to which the drill bit is attached;

(2) attaching a clamp means having a pointer thereon to said drill string adjacent said boring machine to indicate the rotational orientation of the drill bit;

(3) simultaneously rotating and advancing the drill string by means of said boring machine in an axial direction inclined to the earth's surface to establish a borehole in the earth generally in the direction of the drill pipe extending from the drilling machine;

(4) adding a new length of drill pipe as necessary to extend the length of the drill string;

(5) maintaining the orientation of said pointer with respect to said drill pipe when said clamp means is transferred from one drill pipe to a successive length of drill pipe by using a liquid bubble level;

(6) reattaching said clamp means to the drill string adjacent said boring machine as each new length of drill pipe is added to the drill string to continue to indicate the rotational orientation of the drill bit;

(7) continue rotating and advancing the drill string to form a borehole until a change in the direction of the borehole is desired;

(8) stopping the rotation of the drill string;

(9) orienting the rotational position of the drill string with the aid of said clamp means so that the drill bit blade is inclined towards the new direction of the borehole desired;

(10) advancing the drill string and thereby the drill bit a short distance without rotation;

(11) resuming simultaneous rotation and advancement of the drill string for a short distance;

(12) sequentially repeating steps (8), (9), (10) and (11) until the direction of the borehole is in the new direction desired;

(13) thereafter simultaneously rotating and advancing the drill string to advance the borehole until another new direction of the borehole is desired and reattaching said clamp means as each new length of drill pipe is added; and

(14) when another change in the direction of the borehole is desired, repeating steps (8), (9), (10) and (11).

3. In an apparatus for boring a hole in the earth, the apparatus having a frame supportable on the earth's surface, a rotary drilling means supported on the frame for rotating a drill string, a drill string formed by successively connecting together individual drill pipes, the drill string having a rearward end connected to the rotary drilling means and a forward end, a drill bit fixed to the forward end of the drill string, and indicator means for indicating the rotational orientation of the drill bit by observing the rotational orientation of the drill string, wherein the improvement comprises:

said indicator means comprising a ring member, said ring member having a central, axial bore so that the drill pipe forming the drill string may slide into the axial bore, said ring member adapted to be transferred from one drill pipe to a successive length of drill pipe;

means for fixing said ring member to the drill pipe so that said ring member will rotate with the drill pipe when the drill pipe is rotated by the rotary drilling means;

orientation means, fixed to said ring member and rotatable with said ring member, for indicating one orientation of the face of the drill bit, whereby the rotational orientation of said orientation means indicates the rotational orientation of the drill bit; and alignment means for maintaining the orientation of said orientation means with respect to said drill pipe when said ring member is transferred from one drill pipe to a successive length of drill pipe wherein said alignment means comprises a liquid bubble level.

4. An apparatus as recited in claim 3, wherein said orientation means comprises a pointer fixed to said ring-like member.

5. An apparatus as recited in claim 4 wherein the frame comprises a drill pipe support, and wherein said alignment means comprises a pointer fixed to said drill pipe support.

* * * * *

UNITED STATES PATENT AND TRADEMARK OFFICE

CERTIFICATE OF CORRECTION

PATENT NO. : 4,953,638

DATED : September 4, 1990

INVENTOR(S) : RICHARD P. DUNN

It is certified that error appears in the above-identified patent and that said Letters Patent is hereby corrected as shown below:

Col. 1, line 13, after "machines" delete --reference--.

Col. 4, line 37, change "18B" to --18A--.

Col. 5, line 59, change "16A" to --18A--.

Col. 6, line 11, change "84" to --85--.

Signed and Sealed this

Thirty-first Day of December, 1991

*Attest:*

HARRY F. MANBECK, JR.

*Attesting Officer*

*Commissioner of Patents and Trademarks*